United States Patent [19]

Myers

[11] 4,145,786

[45] Mar. 27, 1979

[54] PORTABLE FLOATING APPARATUS

[76] Inventor: James S. Myers, 960 "C" Calle Aragon, Laguna Hills, Calif. 92653

[21] Appl. No.: 881,768

[22] Filed: Feb. 27, 1978

[51] Int. Cl.[2] ..... E01D 15/14

[52] U.S. Cl. ..... 14/27; 14/2.4; 405/68

[58] Field of Search ..... 14/27, 1, 2.4; 52/2, 52/108; 61/1 F

[56] References Cited

U.S. PATENT DOCUMENTS

| | | | |
|---|---|---|---|
| 643,023 | 2/1900 | Wood | 52/2 X |
| 2,987,024 | 6/1961 | Rush | 14/27 X |
| 3,029,558 | 4/1962 | Odenkirk | 52/2 X |
| 3,043,109 | 7/1962 | Erickson | 14/1 X |
| 3,046,850 | 7/1962 | Tellefson | 14/1 X |
| 3,239,862 | 3/1966 | Hire | 14/1 |
| 3,258,800 | 7/1966 | Robinsky | 14/27 |
| 3,496,586 | 2/1970 | Kaufman | 14/27 |
| 3,999,879 | 12/1976 | Stachiw | 14/27 X |

*Primary Examiner*—Nile C. Byers, Jr.

[57] ABSTRACT

Portable floating apparatus is disclosed herein having a plurality of floatable platforms arranged in end-to-end hingable relationship so as to provide a continuous, extendible bridge. Each platform includes inflatable buoyant tubes carried on the sides thereof and having a rigid support member disposed between and coupled to the side buoyant tubes. The sides of the support member are provided with recesses for storage of the tubes in their deflated conditon. The buoyant tubes of each platform are in fluid communication with the buoyant tubes of adjacent platforms whereby a common inflation device not only inflates the tubes but deploys the plurality of platforms in a selected direction.

9 Claims, 9 Drawing Figures

10
11
11'
11''
12
13
14
15
16
17
18
19
20
21
30
31
32
33
34
35
5
4

FIG. 5
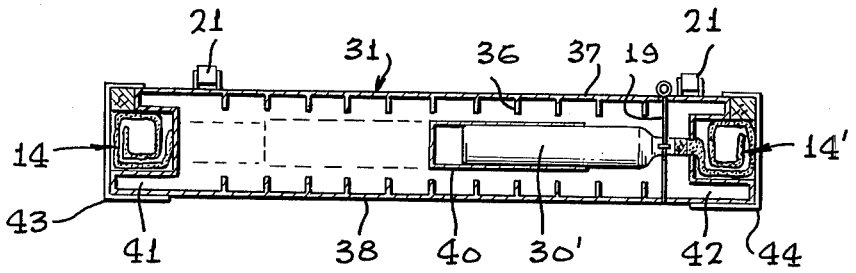
FIG. 6
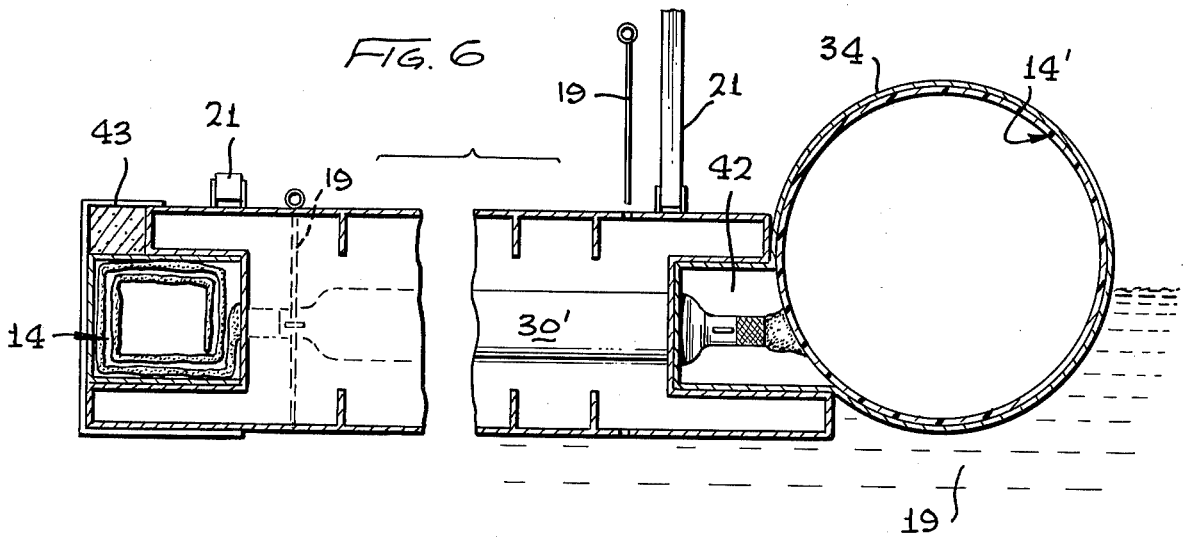
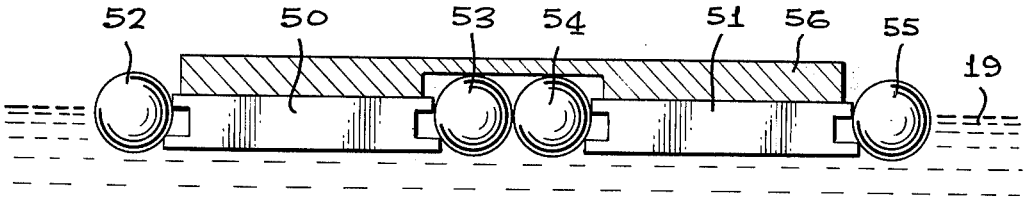
FIG. 7
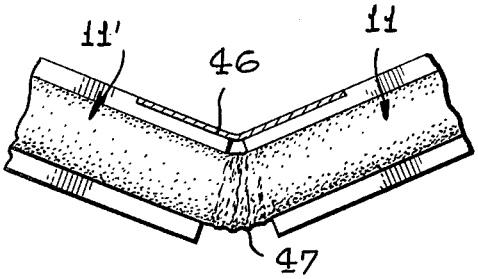
FIG. 8
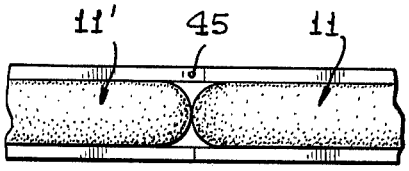
FIG. 9

PORTABLE FLOATING APPARATUS

BACKGROUND OF THE INVENTION

1. Field of the Invention

The present invention relates to inflatable and portable floating structures and more particularly to a novel apparatus of this type and class which includes a plurality of hingable platforms providing a continuous and extensible bridging structure.

2. Brief Description of the Prior Art

In the past, it has been the conventional practice to bridge or cross bodies of water such as rivers, streams or the like by means of portable bridging structures. These structures are generally light in weight and are adapted to be transported over land to the erection site where the parts and pieces are manually put together so that the water-way can be crossed. In some instances, the component parts of the bridging structure are quite heavy and a conventional type of bridge is referred to as the "Bailey bridge" which was used extensively in military operations. In other instances, lightweight wooden platforms have been detachably connected together and covered with steel plate so that a suitable supporting surface is provided between the opposite banks of a river or stream. These portable floating structures are particularly adapted for civilian, military and emergency use when a bridge or a dock is required. Furthermore, such a structure is also useful for exploration and travel in unsettled territory and it may be used to provide a temporary roadway over terrian which is normally impassable to weighted vehicles such as motor vehicles and the like.

Although numerous types and forms of portable floating structures have been previously proposed and are in use, problems and difficulties have been encountered which reduce the total effectiveness of these structures. Many of the structures have components which are constructed of many sections that require assemblage at the construction site and require disassembly each time the structure is moved. Also, the components of the structure have considerable bulk in their disassembled form and require substantial handling and storage space each time the components are moved.

In some instances, inflatable structures have been provided such as is disclosed in U.S. Letters Pat. No. 2,423,832. However, the pontoon bridge disclosed therein employs components which are of a substantially heavy nature and requires a substantial amount of construction by skilled personnel at the assembly site. Other prior art devices have been encountered such as those disclosed in U.S. Letters Pat. No. 3,258,800 and 3,466,685. Such construction as these latter patents disclose appear to be of a lightweight design and not readily suitable for accommodating weighted automotive or motor vehicles. Also, the device disclosed is not deployed in a selected direction by the mere inflation of the device.

In view of the foregoing, it can be seen that a long standing need has existed to provide a lightweight, portable and inflatable bridging structure which may be readily deployed during the inflation procedure and which is of sufficient structural integrity to support and hold weighted objects such as motor vehicles and the like.

SUMMARY OF THE INVENTION

Accordingly, it is among the primary objects of the present invention to provide a novel bridging structure which includes a multiplicity or plurality individual platform units that are hinged together in an end-to-end relationship so as to provide a continuous and extendible bridging structure when deployed. Each of the platform units include a rigid platform having storage recesses on its opposite side for holding inflatable tube members or elements. Means interconnect the tubes from one platform unit to another so that upon inflation, the platform units are readily deployed in a selected direction as the outermost units are inflated in order. Means are provided for securing or coupling the tubes to the opposite sides of the respective platform units whereby a flexible connection strap is produced and suitable inflation means are provided for either inflating each of the tubes associated with a platform unit per se or by inflating all of the tubes at one time by a single inflation means.

In one form of the invention, the platform is composed of a relatively rigid material having internal ribs extending longitudinally so as to provide support. Also, when in storage covers are provided for the opposite sides of the platform units so that the recess is covered for enclosing the respective inflatable tubes.

In other embodiments of the invention, the platform unit may be composed of a plastic-like material such as a polystyrene expanded bead construction and the storage compartments for the tubes may be located so as to deploy the tube from the bottom of the platform rather than from the side. Suitable hand rails or hand supports are hingably carried on the top surface of the platform units to aid personnel in crossing the stream or river using the bridging structure.

Therefore, it is among the primary objects of the present invention to provide a novel bridging structure which is inflatable and by means of inflation provides directional deployment of the bridging structure across a river or stream.

Another object of the present invention is to provide a novel bridging structure composed of a plurality of hingable platform units having inflation means carried on opposite sides of each platform unit wherein the inflatable means are readily stored in side or bottom storage compartments on each of the platform units.

Still another object of the present invention is to provide a novel inflatable bridging structure which is capable of being rapidly deployed from a stowed or stored condition so as to provide a sturdy and dependable support for personnel and motor vehicles such as is demanded in modern military service.

Still a further object of the present invention is to provide a novel inflatable bridging structure which includes inflatable means carried on opposite sides of a plurality of platform units which may be readily deployed by inflation of the inflatable means so that a coextensive and expandable bridging structure may be cantilevered outwardly from an assembly site in a desired direction.

A further object resides in providing a novel emergency personnel support adapted to be employed in rescue procedures involving the crossing or bridging of ice and snow surface, muskeg or bogg terrain or the like.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 5 is a transverse cross-sectional view of the platform unit shown in FIG. 4 as taken in the direction of arrows 5—5 thereof;

FIG. 6 is an enlarged view in section of a platform unit illustrating the buoyant tube inflated on one side thereof so as to be deployed out of its storage recess or compartment while the opposite side of the platform unit illustrates the buoyant tube stored within the storage recess or cavity thereof;

FIGS. 8 and 9 illustrate different hinge connections between the adjacent ends of platform units and wherein FIG. 8 illustrates fluid communication between adjacent ends of buoyant tubes while FIG. 9 illustrates separate inflation tubes; and FIG. 7 illustrates a tandum arrangement of platform units so as to provide a wide bridge for accommodating motor vehicles or the like which incorporates the buoyant tubes of the present invention.

DESCRIPTION OF THE PREFERRED EMBODIMENT

Figures 1, 2, 3, 4:
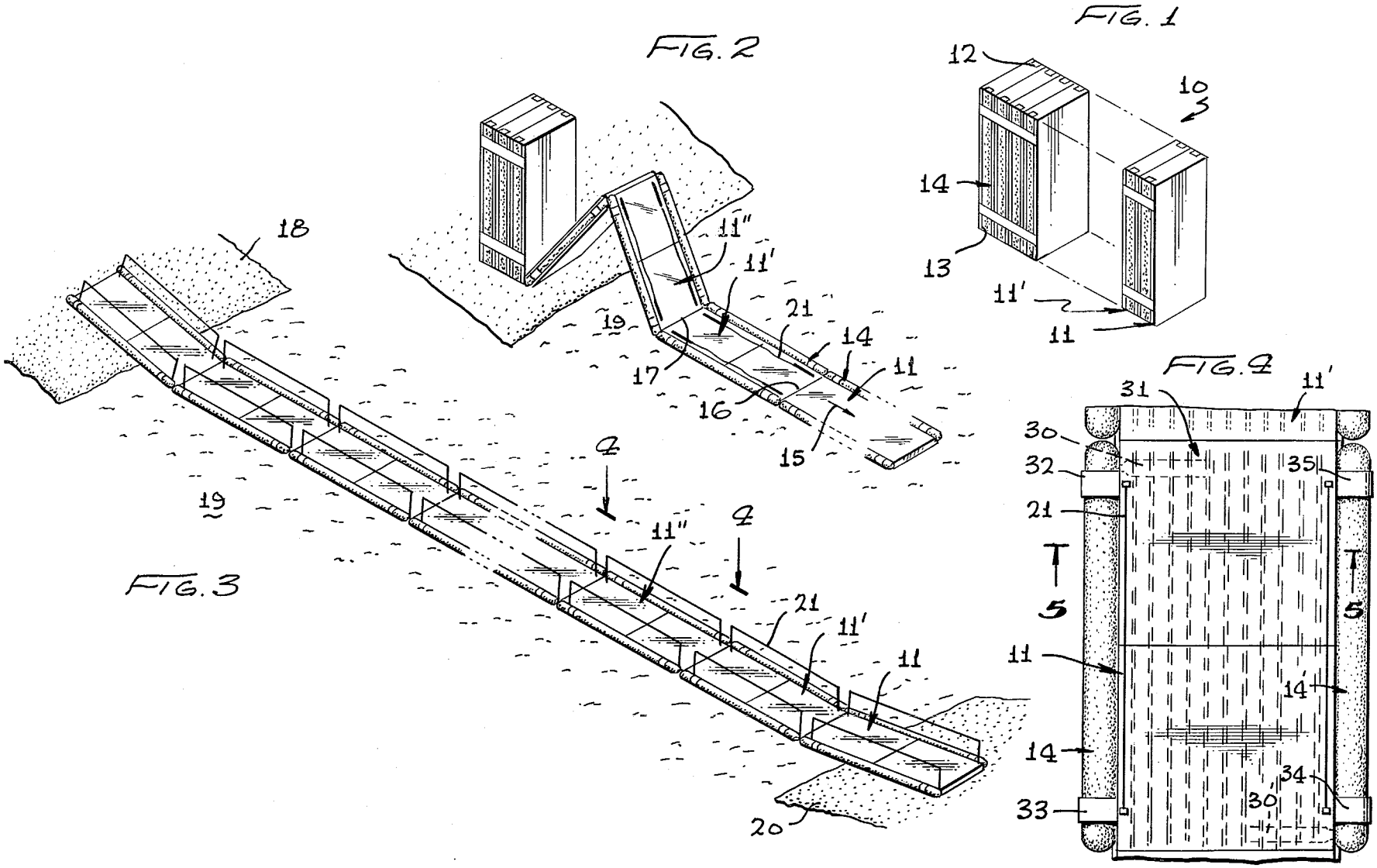
FIG. 1 is a diagrammatic perspective view of the novel inflatable bridging structure of the present invention showing the structure in its transportation or storage condition.
FIG. 2 is a view similar to the view of FIG. 1 illustrating the bridging structure in the process of being deployed across a stream or river.
FIG. 3 is a perspective view of the bridging structure incorporating the present invention illustrating the plurality of platform units having inflatable means on opposite sides thereof bridging the stream or river between the opposite sides of the respective banks.
FIG. 4 is an enlarged view of a platform unit in plan view as taken in the direction of arrows 4—4 of FIG. 3.

Referring to FIG. 1, the novel bridging apparatus of the present invention is shown in the general direction of arrow 10 and includes a plurality of individual platform units identified by numeral 11. Each platform unit is identical to others in the plurality and the platform units are connected together by hinge means in an end-to-end relationship. As shown in FIG. 1, the platform units are in their storage condition for transportation purposes or for storage at a construction or assemblage site. Each of the platform units are provided with lateral storage compartments such as represented by numerals 12 and 13 located on opposite sides of the elongated platform unit 11. The storage compartments are occupied in the storage condition by inflatable means. The inflatable means are in their deflated condition when stored within the storage compartments 12 and 13 and the inflatable means is shown by numeral 14 in a general manner.

With respect to FIG. 2, the bridging apparatus is shown as being partially extended by inflation of the inflation means 14 on opposite sides of each of the respective platform units. The inflation means associated with each platform unit are inflated in a sequence commencing with the outboard or first platform unit in the series followed in succession by the next platform unit thereto and so forth. By this procedure, the platform units are forced into a selected direction such as is indicated by arrow 15. Also, it can be seen in FIG. 2 that the platform units are hinged together at alternate ends so that an accordian arrangement is produced. For example, the first platform unit 11 is hinged to platform unit 11' at their adjacent ends by hinge means 16. In the stack shown in FIG. 1, hinge 16 is at the top of the stack while the adjacent ends of platform units 11 and 11' at the bottom of the stack do not incorporate a hinge. However, in the next arrangement of platform units, platform unit 11'' includes a hinge 17 located at the bottom of the stack when in the storage position shown in FIG. 1. This relationship is again shown in the next pair of platform units wherein the hinge is disposed at the bottom adjacent ends of the next pair of platform units. In order to achieve directional deployment of the multiplicity of platform units, the respective inflation means on opposite sides of each of the panels are connected in fluid communication with adjacent inflation means on the next platform unit in the series and on the same side of the apparatus. Therefore, when a pressurized fluid is introduced into the inflation means 14, the first platform unit 11 will inflate and push out forwardly from the stack and then the next platform unit 11' will have its inflation means inflated so as to push out from the stack and the remaining platform units will be so inflated accordingly.

As shown in FIG. 3, the plurality of platform units are fully deployed and extend from one bank 18 of a stream 19 to the opposite bank 20. The first platform unit in the series is identified by numeral 11 and is partially resting on the bank 20 while the remainder of the plurality of platform units extend across the water on the top surface thereof back to the deployment site on bank 18. Once the units have been so deployed, hand rails 21 may be elevated on opposite sides of the platform units and these may be readily grasped by personnel using the bridging structure. A feature of the invention resides in the fact that a high load or support factor is provided inasmuch as the platform units are supported by their undersides in immediate contact with the surface of the water. Therefore, all loads which are placed on the platform units are distributed over the unit to the surface of the supporting water therebeneath. For this reason, it is important to note that the inflatable means are at the sides of the platform units so that the platform unit may rest on the surface of the water while the buoyant inflatable means supports the units.

Referring now in detail to FIG. 4, a platform unit such as unit 11 is illustrated wherein the inflatable means 14 on opposite sides of the unit are in their inflated and water supporting position. Means for inflating the inflation tubes 14 are represented by numeral 30 which is a source of high pressure air having suitable valve means coupled to the interior of the tubes. Inflation means 30' is associated with buoyant inflatable tube 14'. It can be seen from this figure that the tubes 14 and 14' are coupled to the central platform 31 of the unit by flexible straps 32, 33, 34 and 35 respectively. These straps retain the tubes when they are inflated. It is to be understood that during the inflation period, the tubes will expand out of their storage compartments on opposite sides of the platform unit and will extend laterally until restrained by the plurality of straps. The straps encircle the respective ends of the buoyant tubes and are attached to the platform 31.

Referring now in detail to FIG. 5, it can be seen that the platform 31 is of a rigid material and incorporates a plurality of longitudinally extending ribs such as identified by numeral 36. The platform 31 is of a box-like structure having an upper panel 37 and a lower panel 38. The inflator 30' is disposed in a holder 40 between the opposing surfaces of panels 37 and 38. The opposite sides of the platform include storage compartments 41 and 42 which store the buoyant tubes 14 and 14' in a folded condition. For convenience in storage, snap on covers 43 and 44 are employed for protecting the expandable, inflatable tubes 14 and 14' while they are stored within the respective compartments.

FIG. 6 is similar to the view of FIG. 5 illustrating the tube 14 in its stored position; however, tube 14' has been inflated by the inflater 30' so that it has expanded out of the storage compartment 42. Expansion of the tube is restrained by the strap 34 which encircles the tube and is fastened to the inner wall of the platform defining the compartment 42. A feature of the invention is illustrated wherein the tube is at the side of the platform unit so that the bottom panel 38 will rest on or slightly below the surface of the water depending on the applied load. Therefore, a relatively high strength to weight ratio platform unit may be employed.

FIG. 9 illustrates one form of a hinge mechanism for joining the adjacent ends of platform units which takes the form of a hinge pin 45 joining platform units 11' with platform unit 11. In FIG. 8, another embodiment is illustrated wherein a flexible plastic impregnated strap 46 serves as a hinge between the units 11' and 11. In this embodiment, the tubes 14 carried on the same side of the hinged platforms are interconnected by an air duct 47 so that a single high pressure device may supply air to more than one buoyant tube. Therefore, it is to be understood that the present invention includes a separate inflation means associated with each platform unit or a single inflation means may be employed when the inflation tubes are interconnected by the hinge ducts 47.

In FIG. 7, another embodiment of the invention is illustrated wherein each of the platform units comprise platforms of a polystyrene foam composition and are respectively identified by numerals 50 and 51. These platforms are placed in tandum between floatation tubes 52, 53, 54 and 55. As was previously described, storage compartments are provided in the sides of the platforms for storing the inflatable units 52–55 inclusive. When inflated, these tubes are on the side of the platform units so that the platforms 50 and 51 either reside on the surface or immediately below the surface of the water. For tandum use, a surface platform 56 is employed for supporting relatively heavy loads such as motor vehicles.

In view of the foregoing, it can be seen that the bridging apparatus of the present invention provides a novel means for spanning or crossing a body of water such as a river or stream. The apparatus is directionally deployed by means of selective inflation of a plurality of platform units in a proper sequence so that the plurality of platform units unfold accordian style due to the expansion and inflation pressure of the device. The device may be conveniently stored in which case the buoyant inflation tubes are maintained within storage compartments on the sides of each of the platform units and covers are provided for protecting the deflated tubes. Upon inflation, the covers will automatically snap off as the tubes expand due to the inflation pressure. Inflation pressure may be provided from a common inflation means to all of the tubes or each platform unit may contain and carry its own inflation unit.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An extendable portable bridging apparatus adapted to be supported on the surface of water comprising:

a plurality of individual platform units arranged in an end-to-end relationship so as to provide a continuous and uninterrupted passageway across a body of water wherein the underside of the platform units are supported on the surface of the water body;

inflatable means carried on the opposite sides of each of said platform units and said inflatable means includes expandable tubes carried on opposite sides of each of said individual platform units;

strap means retaining said tubes to their respective platform unit sides so that when inflated, said tubes rest on the surface of the body of water;

hinge means pivotally coupling adjacent ends of said individual platform units; and inflation means operably connected to said inflatable means for inflating thereof and said inflatable means being responsive to inflation so as to expand and forceably urge said plurality of individual platform units towards a desired direction.

2. The invention as defined in claim 1 wherein:

each platform unit includes an elongated storage compartment on the opposite sides of said platform unit for storage of said tubes in a deflated condition;

each one of said storage compartments having a releasable cover thereover to enclose said tube in its deflated condition.

3. The invention as defined in claim 2 wherein:

each of said platform units are composed of a material having a high strength-to-weight ratio whereby the bottom of said platform unit rests on the surface of water beneath in a load transferring relationship.

4. The invention as defined in claim 3 wherein:

said inflatable means are buoyant for supporting each of said platform units on the water in cooperating with said load transferring relationship.

5. The invention as defined in claim 4 wherein:

each of said inflatable means carried on said platform units is in fluid communication with each other and wherein said inflation means initiates inflation on a selected end platform unit of said plurality whereby subsequent platform unit inflatable means become serially inflated in a predetermined sequence.

6. The invention as defined in claim 5 wherein:

each of said platform units includes a plurality of spaced apart stiffener ribs extending parallel to each other along the length of said platform unit.

7. The invention as defined in claim 6 wherein:

each of said platform units includes a foldable handrail along the edge marginal region of each side of said platform unit.

8. The invention as defined in claim 7 wherein:

said hinge means comprises a reinforced fabric strap secured at its opposite ends to the adjacent ends of said platform units.

9. The invention as defined in claim 4 wherein:

each of said inflatable means is carried on a respective one of said platform units and each platform unit carries a separate inflation means therefor.

* * * * *